US006644913B2

(12) United States Patent
Smith

(10) Patent No.: US 6,644,913 B2
(45) Date of Patent: Nov. 11, 2003

(54) TURBINE MOTOR WITH NOISE REDUCTION SYSTEM

(76) Inventor: Paul Michael Smith, 40 Magnetic Drive #58, Toronto, Ontario (CA), M3J 2C4

( * ) Notice: Subject to any disclaimer, the term of this patent is extended or adjusted under 35 U.S.C. 154(b) by 15 days.

(21) Appl. No.: 10/082,358

(22) Filed: Feb. 26, 2002

(65) Prior Publication Data

US 2003/0161720 A1 Aug. 28, 2003

(51) Int. Cl.[7] ..... F04D 29/66
(52) U.S. Cl. ..... 415/119; 415/121.2; 415/175
(58) Field of Search ..... 415/119, 121.2, 415/175, 176, 108

(56) References Cited

U.S. PATENT DOCUMENTS 5,074,467 A * 12/1991 Geberth ..... 239/8
5,556,255 A * 9/1996 Kieffer ..... 415/212.1
5,573,371 A * 11/1996 Kieffer ..... 415/182.1
6,037,684 A * 3/2000 DeYoung et al. ..... 310/58

OTHER PUBLICATIONS

Maurey Enterprises, Inc., Maury–Wagner/SprayTECH—HVLP, Paint Sprayers, www.pressurecleaners.com/pages/wagner.htm, SprayTECH HVLP Sprayers, Jan. 21, 2002.

CSS Compliant Spray Systems, Tuned Noise Reduction Upright Turbines, www.compliantspraysystems.com/accusprayfinishingequipment/turbine_systems/tu . . . , Dec. 31, 2001.

* cited by examiner

*Primary Examiner*—Ninh H. Nguyen
(74) *Attorney, Agent, or Firm*—Nancy E. Hill; Lynn C. Schumacher

(57) ABSTRACT

A turbine motor of the present invention includes a noise reduction system. The turbine motor includes a housing, a motor, a cooling fan, an air intake assembly, an exhaust assembly, an air intake motor cover assembly and a conduit. The motor is positioned in the housing and the motor has an air intake. The cooling fan is attached to the motor and is for cooling it. The air intake assembly is proximate to the cooling fan and is attached to the housing. The exhaust assembly is proximate to the cooling fan and is attached to the housing. The air intake motor cover assembly is proximate to the air intake on the motor and is attached to the housing. The conduit extends between the air intake assembly and the air intake motor cover.

15 Claims, 4 Drawing Sheets

TURBINE MOTOR WITH NOISE REDUCTION SYSTEM

FIELD OF THE INVENTION

This invention relates to turbine motors and in particular turbine motors with noise reduction systems.

BACKGROUND OF THE INVENTION

Turbines are well known and have been used for a number of decades in a wide variety of applications. These turbines are often used in association with paint sprayers, hot and cold high pressure cleaners and industrial cleaning systems. However, one shortcoming of the turbines is that they are extremely noisy. For example from 3 feet away, the noise, as measured in decibels is around 86. This is a similar intensity to that of a typical motorcycle passing on the street. Another comparison would be with the sound of an un-muffled "shop vac". Although a turbine used with a spray gun is about 15 to 20 feet away while a "shop vac" is about 6–8 feet away, the "shop vacs" are usually only used intermittently whereas the turbines may be used continuously throughout a full eight hour shift.

Recently some efforts have been made to reduce or muffle the noise from a turbine. For example Wagner Spray Tech Corporaton has a quieter turbine under their brand name Capspray™. The Capspray™ turbine includes large pans attached to each side of the turbine case. One pan is for the air being drawn in by the cooling fan and the other pan is for the air being drawn in by the main fans. Inside these pans are passages lined with soundproofing material. These pans however considerably add to the overall size of the turbine.

Another alternative is the Accuspray™, Inc. 2000 series. The Accuspray™ turbine has a case within a case. The inner case is for the motor and it is surrounded by a soundproof insulation jacket. The soundproof insulation jacket however causes the motor to run hotter and therefore a larger cooling fan, which is vented to the outside, is required. Air is drawn through one air intake only into a space lined with soundproofing material, the space is the space between the two cases. The air is split into two once it has passed through the space lined with soundproofing material. One airstream is drawn in by the cooling fan, the other is drawn through the space between the two cases to the larger turbine main fans. This design has a number of drawbacks. For example, it is relatively expensive to manufacture. In addition, since this design requires an extra cooling fan that is vented directly to the outside, a direct conduit for noise is provided. Further the cooling fan that is required would be a much larger cooling fan than is generally required in these turbines.

Accordingly it would be advantageous to provide a turbine with a noise reduction system that is easy to manufacture, relatively inexpensive and is compact.

SUMMARY OF THE INVENTION

The present invention is a turbine motor with a noise reduction system. The turbine motor includes a housing, a motor, a cooling fan, an air intake assembly, an exhaust assembly, an air intake motor cover assembly and a conduit. The motor is positioned in the housing and the motor has an air intake. The cooling fan is attached to the motor and is for cooling it. The air intake assembly is proximate to the cooling fan and is attached to the housing. The exhaust assembly is proximate to the cooling fan and is attached to the housing. The air intake motor cover assembly is proximate to the air intake on the motor and is attached to the housing. The conduit extends between the air intake assembly and the air intake motor cover.

Further features of the invention will be described or will become apparent in the course of the following detailed description.

BRIEF DESCRIPTION OF THE DRAWINGS

The invention will now be described by way of example only, with reference to the accompanying drawings, in which.

DETAILED DESCRIPTION OF THE INVENTION

Figure 1:
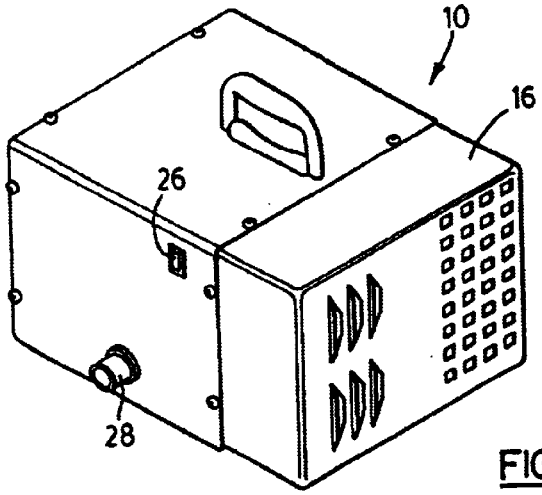
FIG. 1 is a perspective view of the turbine with a noise reduction system constructed in accordance with the present invention.
Figure 2:
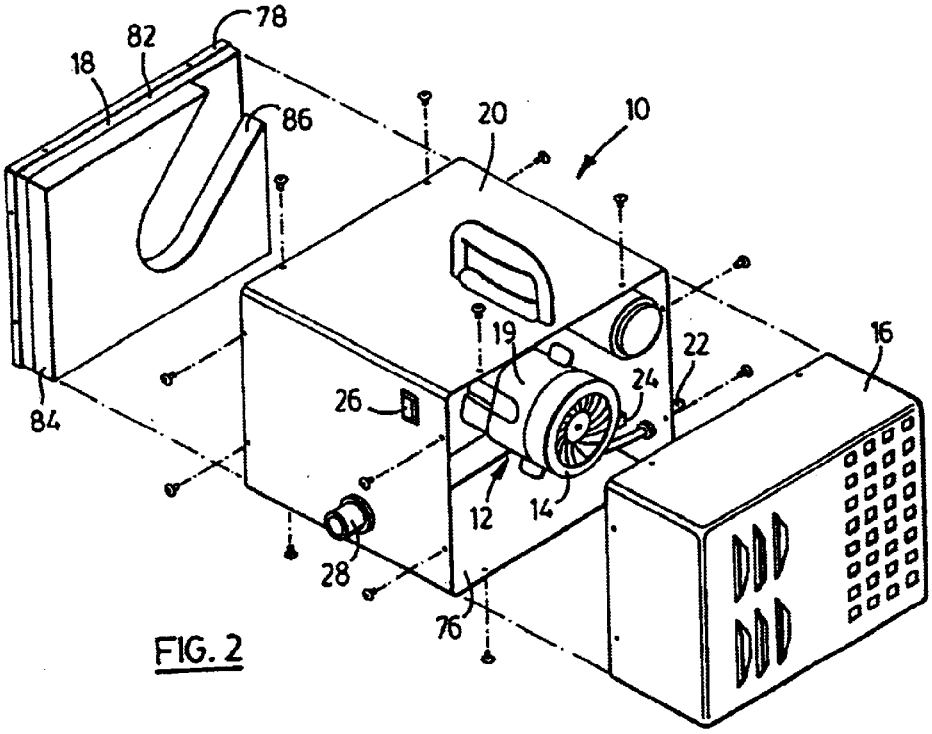
FIG. 2 is a blown apart perspective view of the turbine of FIG. 1 as viewed from the air intake and exhaust assembly side of the turbine.

Referring to FIGS. 1 and 2, the turbine of the present invention is shown generally at 10. The turbine includes a vacuum motor 12 with a cooling fan 14, an air intake and exhaust assembly 16 and a cover assembly 18.

The vacuum motor 12 with cooling fan 14 may be any conventional motor. The cooling fan 14 is typically a bypass fan meaning that the air drawn in by the small cooling fan 14 is separate from the vacuum air, drawn in by the larger fans of the vacuum motor 12. One such vacuum motor is manufactured by Ametek-Lamb Electric Division of Ametek, Inc. of Ohio and is their 3-stage vacuum motor #116765–00. The small cooling fan 14 is typically the size of a fan on a personal computer. The primary purpose of cooling fan 14 is to cool the vacuum motor 12. Vacuum motor 12 tends to run very hot since it typically spins at 19,000–21,000 rpm. Without this cooling fan, the motor would quickly overheat and burn out.

At the opposite end of the motor assembly from the cooling fan 14 are much larger vacuum fans that are used for the motor 12. The vacuum fans are typically encased in a protective can or motor housing 19. The number of fans and their speed determines how much pressure and cubic feet per minute (cfm) can be generated. Motor 12 may be a variety of different sizes. The sizes of the motors are typically described as 'stages' and relate to the number of vacuum fans included therewith. Typical sizes of the motors are single stage, two-stage, three-stage and four-stage. The area between the cooling fan and the vacuum fan(s) is taken up with the windings of the motor onto which the air from the cooling fan is directed. As expected, the more fans, the more power and the noisier the motor. Motor 12 includes a power cord 22, a breaker (the cord for which is shown at 24) and a power switch 26. Motor 12 has an outlet 28 that extends from the motor through the turbine housing 20 so that the user may attach it to a paint sprayer or other device.

Motor 12 and cooling fan 14 are housed in the protective can or motor housing 19. The motor housing 19 is typically made from metal. At the cooling fan 14 end of the housing is the air intake and exhaust assembly 16 and at the other end is the cover assembly 18. Each assembly 16, 18 form part of the turbine housing 20. Turbine housing 20 is typically made from metal or plastic and most often made from steel.

Figure 5:
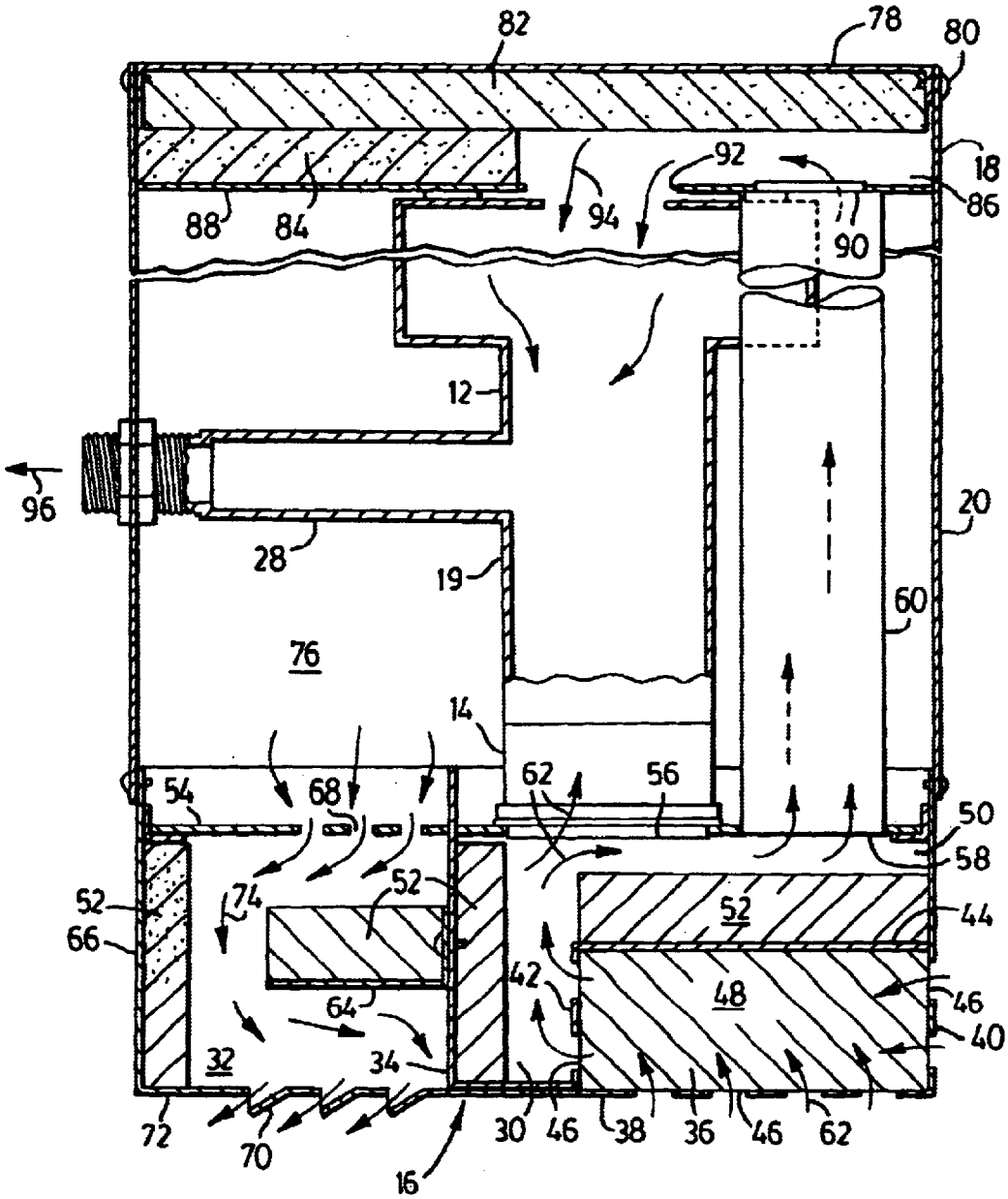
FIG. 5 is a cross sectional view showing the air flow through the turbine of the present invention.

The air intake and exhaust assembly 16 includes an intake portion 30 and an exhaust portion 32 as best seen in FIG. 5. A partition 34 separates intake portion 30 from exhaust portion 32. Intake portion 30 has an entrance portion 36. Entrance portion has a front wall 38, an outside side wall 40, an inside side wall 42 and a back wall 44. Front wall 38, outside side wall 40 and inside side wall 42 each have a plurality of apertures 46 formed therein. Back wall 44 is solid and has no apertures formed therein. Preferably a filter 48 is positioned in entrance portion 36. Filter 48 may be from foam for example a urethane type foam. Air in the air intake and exhaust assembly 16 passes from the intake portion 30 into the baffled portion 50. Baffled portion 50 includes two soundproofing slabs 52, one attached to partition 34 and the other attached to the back of back wall 44. Air intake and exhaust assembly 16 is provided with a back plate 54 that has a fan hole 56 which is in registration with cooling fan 14 and a conduit hole 58 which is in registration with conduit 60 which will be described in more detail below. The flow of the air through intake portion 30 is shown with arrows 62. In use the air is sucked into the entrance portion 36 through the filter 48 and then into the baffle portion 50 where it is divided and some is drawn into the cooling fan 14 and the remainder is drawn into the conduit 60.

The exhaust portion 32 of the air intake and exhaust assembly 16 has an intermediate wall 64 extending inwardly from partition 34. Outside wall 66 and intermediate wall 64 have soundproofing slabs 52 attached thereto. Back plate 54 has a plurality of exhaust apertures 68 formed therein thereby providing access for the exhaust air from the cooling fan 14 into the exhaust portion 32. Louvers 70 are formed in the front wall 72 of exhaust portion 32. The flow of air in the exhaust portion 32 are shown with arrows 74. Air from the cooling fan 14 is exhausted in the inside 76 of the housing 20. Its only outlet is through exhaust aperture 68 in back plate 54 into exhaust portion 32 where it is muffled by soundproofing slabs 52 attached to outside wall 66 and intermediate wall 64. Thereafter the air is exhausted to the outside through louvers 70.

Figure 3:
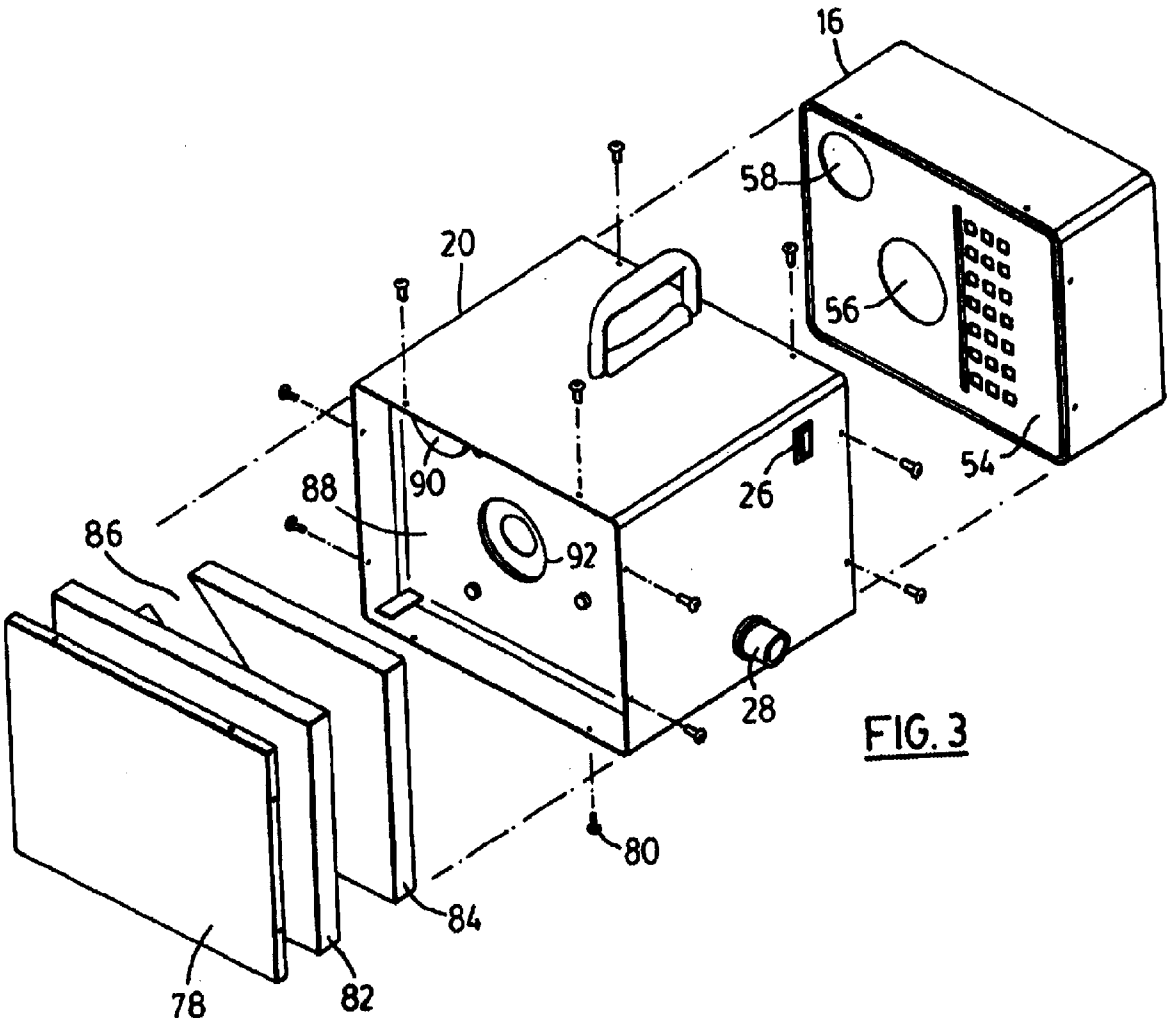
FIG. 3 is a blown apart perspective view of the turbine of FIG. 1 as viewed from the closed side of the turbine.
Figure 4:
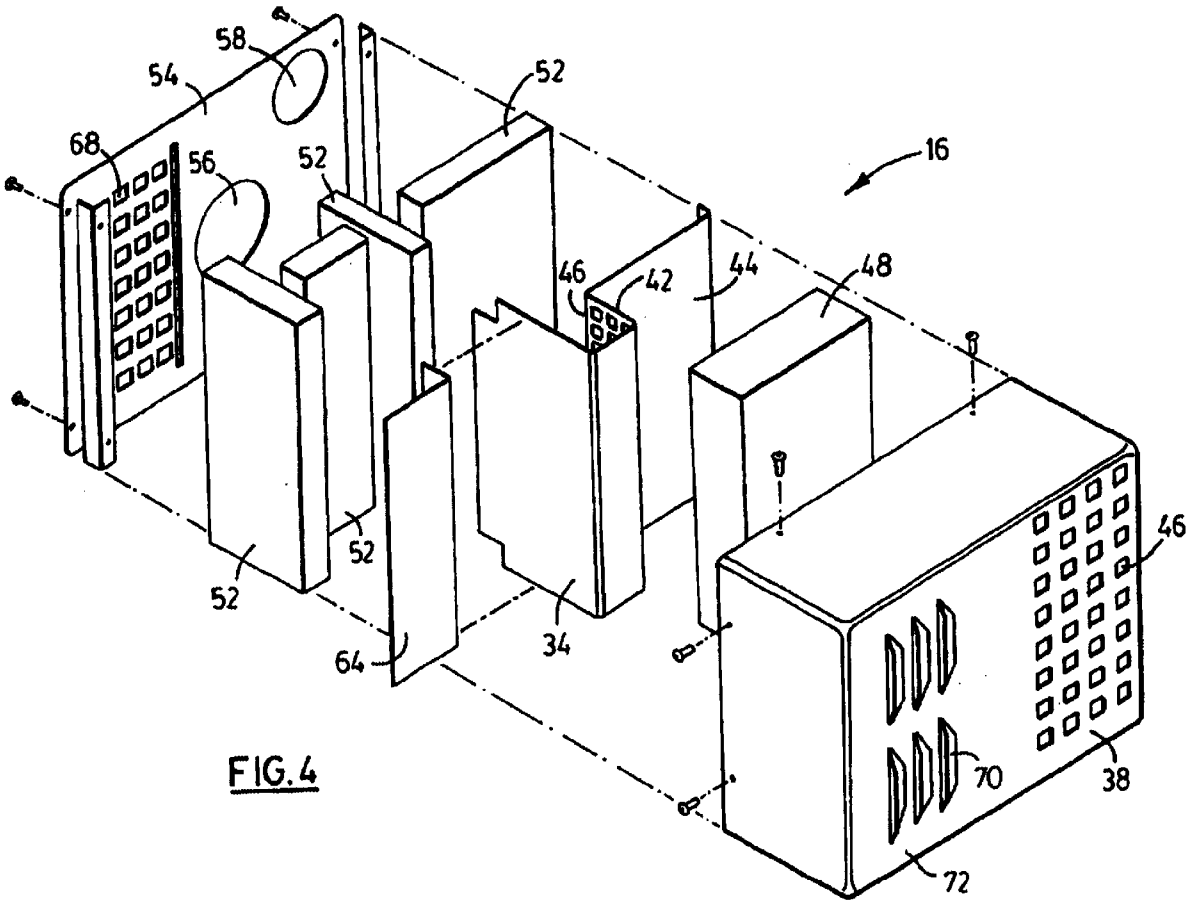
FIG. 4 is a blown apart view of the air intake and exhaust assembly.

Referring to FIGS. 3 and 5, cover assembly 18 is at the opposite end of housing 20 from air intake and exhaust assembly 16. Cover assembly covers the intake portion of motor 12. Cover assembly 18 includes an outside cover 78 that attached to housing 20 with a plurality of screws 80. A first cover soundproofing slab 82 fits snugly inside cover 78. A second cover soundproofing slab 84 has a generally U-shaped cut out portion 86. The second cover slab 84 is attached to the first cover slab 82. U-shaped cut out portion 86 is shaped such that when assembled it is in registration with conduit 60 and motor intake 92.

A motor cover plate 88 is attached on the inside of turbine housing 20 and is best seen in FIG. 3. Motor cover plate 88 has a conduit hole 90 and a motor intake hole 92. When assembled U-shaped cut out portion 86 extends from conduit hole 90 to intake hole 92 such that air that has been drawn into conduit 60 is drawn into U-shaped cut out portion 86 and into motor intake as shown at arrows 94 on FIG. 5.

A conduit 60 extends between motor cover plate 88 and back plate 54. Preferably conduit 60 is spaced from motor 12. Preferably conduit 60 is manufactured from PVC.

In use air is drawn in through intake portion 30 of the air intake and exhaust assembly 16 wherein the air passes through a filter 48 and through passages lined with soundproofing slabs 52 as shown by arrows 62 in FIG. 5. The air is split and one portion is drawn into the cooling fan 14 and the other is drawn into the conduit 60. The air passes from the conduit 60 into the cover assembly 18 where it is drawn into the fans of the motor 12 as shown by arrows 94. The cover assembly 18 has multiple layers of soundproofing 82, 84 with a cut out portion 86 for the air to travel from the conduit 60 to the motor intake hole 92. Air is then passed through the fans of motor 12 and exits through outlet 28 as shown by arrow 96. It will be appreciated by those skilled in the art that the cover assembly provides multilayers of soundproofing at the air Intake end of the motor 12. This is generally considered the noisy end of the motor 12. Since the cover assembly has at least one soundproofing slab 82 that covers the entire end of the motor 12 it provides an uninterrupted slab of soundproofing which clearly would provide more muffling per soundproofing material than a cover that allows air to be drawn directly into the motor through channels that include soundproofing.

It will be appreciated that the above description relates to the invention by way of example only. Many variations on the invention will be obvious to those skilled in the art and such obvious variations are within the scope of the invention as described herein whether or not expressly described.

What is claimed as the invention is:

1. A turbine motor with a noise reduction system comprising:

a housing;

a motor having an air intake and being positioned in the housing;

a cooling fan for cooling the motor and being attached thereto;

an air intake assembly proximate to the cooling fan and being attached to the housing;

an exhaust assembly proximate to the cooling fan and being attached to the housing;

an air intake motor cover assembly proximate to the air intake on the motor and being attached to the housing; and a conduit extending between the air intake assembly and the air intake motor cover.

2. A turbine motor as claimed in claim 1 wherein the air intake assembly includes a filter at the entrance to the air intake assembly.

3. A turbine motor as claimed in claim 2 wherein the air intake assembly has air passageways and further including a plurality of soundproofing slabs in the air passageways.

4. A turbine motor as claimed in claim 3 wherein the exhaust assembly has exhaust passageways and further including a plurality of soundproofing slabs in the exhaust passageways.

5. A turbine motor as claimed in claim 4 wherein the air intake assembly and the exhaust assembly are a combined air intake and exhaust assembly.

6. A turbine motor as claimed in claim 5 wherein the air intake motor cover assembly includes a cover, a first cover soundproofing slab attached to the cover and a cover passageway from the conduit to the motor air intake.

7. A turbine motor as claimed in claim 6 further including a second cover soundproofing slab attached to the first cover sound proofing slab, the second cover soundproofing slab having a portion cut out thereof to form the cover passageway.

8. A turbine motor as claimed in claim 6 further including a second cover soundproofing slab attached to the first cover sound proofing slab, the second cover soundproofing slab having a portion cut out thereof to form the cover passageway.

9. A turbine motor as claimed in claim 8 wherein the motor air intake is at one end of the motor and the cooling fan is at the other end of the motor and the air intake and exhaust assembly is at one end of the housing and the air intake motor cover is at the other end of the housing.

10. A turbine motor as claimed in claim 1 wherein the conduit is manufactured from PVC.

11. A turbine motor as claimed in claim 1 wherein the motor is one of a single stage motor, a two-stage motor, a three-stage motor and a four-stage motor.

12. A turbine motor as claimed in claim 1 wherein the housing is manufactured from steel.

13. A turbine motor as claimed in claim 1 wherein the exhaust assembly has exhaust passageways and further including a plurality of soundproofing slabs in the exhaust passageways.

14. A turbine motor as claimed in claim 13 wherein the air intake assembly and the exhaust assembly are a combined air intake and exhaust assembly.

15. A turbine motor as claimed in claim 1 wherein the air intake motor cover assembly includes a cover, a first cover soundproofing slab attached to the cover and a cover passageway from the conduit to the motor air intake.

* * * * *